United States Patent [19]

Buzzichelli et al.

[11] 4,155,463

[45] May 22, 1979

[54] HOISTING ASSEMBLY

[76] Inventors: Lilian J. Buzzichelli, 50, allée Jaurès; Kleber G. Roy, 6, rue Villemur, both of Toulouse, France

[21] Appl. No.: 911,033

[22] Filed: May 30, 1978

Related U.S. Application Data

[63] Continuation of Ser. No. 741,105, Nov. 11, 1976, abandoned.

[30] Foreign Application Priority Data

Nov. 19, 1975 [FR] France ..... 75 35270

[51] Int. Cl.[2] ..... B66C 23/72

[52] U.S. Cl. ..... 212/48

[58] Field of Search ..... 212/48, 49, 56; 214/142

[56] References Cited

U.S. PATENT DOCUMENTS

| | | | |
|---|---|---|---|
| 2,364,493 | 12/1944 | Olinski | 212/49 |
| 2,703,180 | 3/1955 | Brown | 212/48 |
| 3,034,661 | 5/1962 | Pollack et al. | 212/56 |
| 3,266,636 | 8/1966 | Dorn | 212/49 |
| 3,685,668 | 8/1972 | Suverkrop | 212/59 R |

FOREIGN PATENT DOCUMENTS

| | | | |
|---|---|---|---|
| 6802347 | 8/1969 | Netherlands | 212/48 |
| 245312 | 4/1969 | U.S.S.R. | 212/48 |

*Primary Examiner*—Lawrence J. Oresky
*Attorney, Agent, or Firm*—Cushman, Darby & Cushman

[57] ABSTRACT

A hoisting assembly for hoisting loads comprising a jib boom and a counterweight arm extending in opposite directions and pivotally mounted on a supporting means for pivoting in a same vertical plane, and interconnected by means of an adjustable connecting means allowing their relative angular position to be changed, said boom and said counterweight arm building a pendular assembly swinging around said supporting means automatically and taking a balanced position whatever the load carried by the boom is.

5 Claims, 2 Drawing Figures

HOISTING ASSEMBLY

This is a continuation of application Ser. No. 741,105 filed Nov. 11, 1976, now abandoned.

BACKGROUND OF THE INVENTION

1. Field of the Invention

The present invention relates to a hoisting assembly and, more particularly to a hoisting crane of the jib type having a jib boom and a counterweight arm.

2. Description of the Prior Art

In hoisting assemblies having a jib boom and a counterweight, said counterweight is generally in fixed relationship with the supporting means to counterbalance the force due to the load which is hanging from the jib boom. In such assemblies, the torques due to the respective weights of the counterweight and of the load counterbalance one another solely for a precise weight of the load. When the load does not have exactly this weight, it results therefrom a tipping over of the jib boom and counterweight arm assembly with respect to the supporting means. In such an assembly, it is then necessary to provide either a supporting structure which ensures the assembly to be stable even in spite of the tipping over torque, or mass means disposed upon the structure, generally at its base, to counterbalance said tipping over torque.

OBJECTS OF THE INVENTION

It is an object of the present invention to provide a hoisting assembly which does not provoque a torque reaction on the structure supporting the assembly.

There is another object of the present invention to provide a hoisting assembly which can accomodate fierce variations of the vertical load without injuring the supporting structure.

SUMMARY OF THE INVENTION

In order to meet these objects, there is provided a hoisting assembly of a crane type having a jib boom and a counterweight arm disposed respectively on each side of a support, and which are pivotable in a vertical plane in a variable angular relationship one to each other in such a way that the resultant of the forces due to the respective weights of the counterweight and of the load always passes through the axis of the vertical pivot on which the whole assembly is rotatably mounted. It results therefrom that the assembly is in a stable equilibrium whatever the distance between the load to be lifted and the rotation axis is. The only resulting bearing strain is then a vertical force passing through the bearing point of the supporting means for supporting the whole structure whereby no tipping torque is transmitted to the structure carrying the whole hoisting assembly.

According to a feature of the present invention, the jib boom and the counterweight arm are journaled on a common shaft or on distinct shafts.

According to another feature of the present invention, the hoisting assembly comprises a jib boom and a counterweight arm located in a same vertical plane, and extending in opposite directions and pivotally mounted upon a supporting means to be pivoted in a vertical plane, said supporting means bearing upon a vertical supporting structure of any known construction by means of a vertical pivoting means which enables the whole assembly, i.e. jib boom and counterweight, to rotate over 360° in an horizontal plane. The jib boom may carry one or several hooks for suspending a load on a hook hanging from a trolley or a dolly movable along the jib boom, the position of said trolley being determined for example by a control means.

According to another embodiment of the present invention, the supporting means is hanging on to an upper structure with respect to which it is rotatable over 360° around a vertical pivoting means. The jib boom may comprise a single proper boom or beam or two articulated members. The loads to be lifted are suspended on the jib boom by hooks which are connected to the jib boom by a connecting means such as, for example, a garnet or a pulley-block.

In the case where the jib boom comprises a unique beam, one hook is connected to the outer end of the boom and the other hooks are disposed between said outer end and the pivoting axis of the boom in order to allow a load to be taken up or taken down at any distance between the pivoting axis of the assembly and the maximum reach which corresponds to the case where the jib boom is horizontal.

In the case where the jib boom is constituted by two boom members, said boom comprises an inner member which is pivotally mounted upon the supporting means of the assembly, and an outer member which is pivotally mounted upon the outer end of the inner member to be pivotable in a vertical plane, said outer member being connected by an adjustable connecting means to a point on the inner member of the boom. The hooks are respectively connected to each of the boom members by a connecting means such as a classical garnet or pulley-block. This arrangement enables the hooks to be moved and, consequently, a load to be moved across the space between the outermost end of the boom and the supporting structure for supporting the whole hoisting assembly.

The present invention then provides a hoisting assembly pivotally mounted on a supporting means and both pivoting in a vertical plane in angular relationship, in such a manner that the hoisting assembly remains at any moment balanced on its supporting means and does not induce lateral forces on said supporting means.

The foregoing and other objects are attained by the means described herein and illustrated upon the accompanying drawings, in which:

DETAILED DESCRIPTION OF THE DRAWINGS

Figure 1:
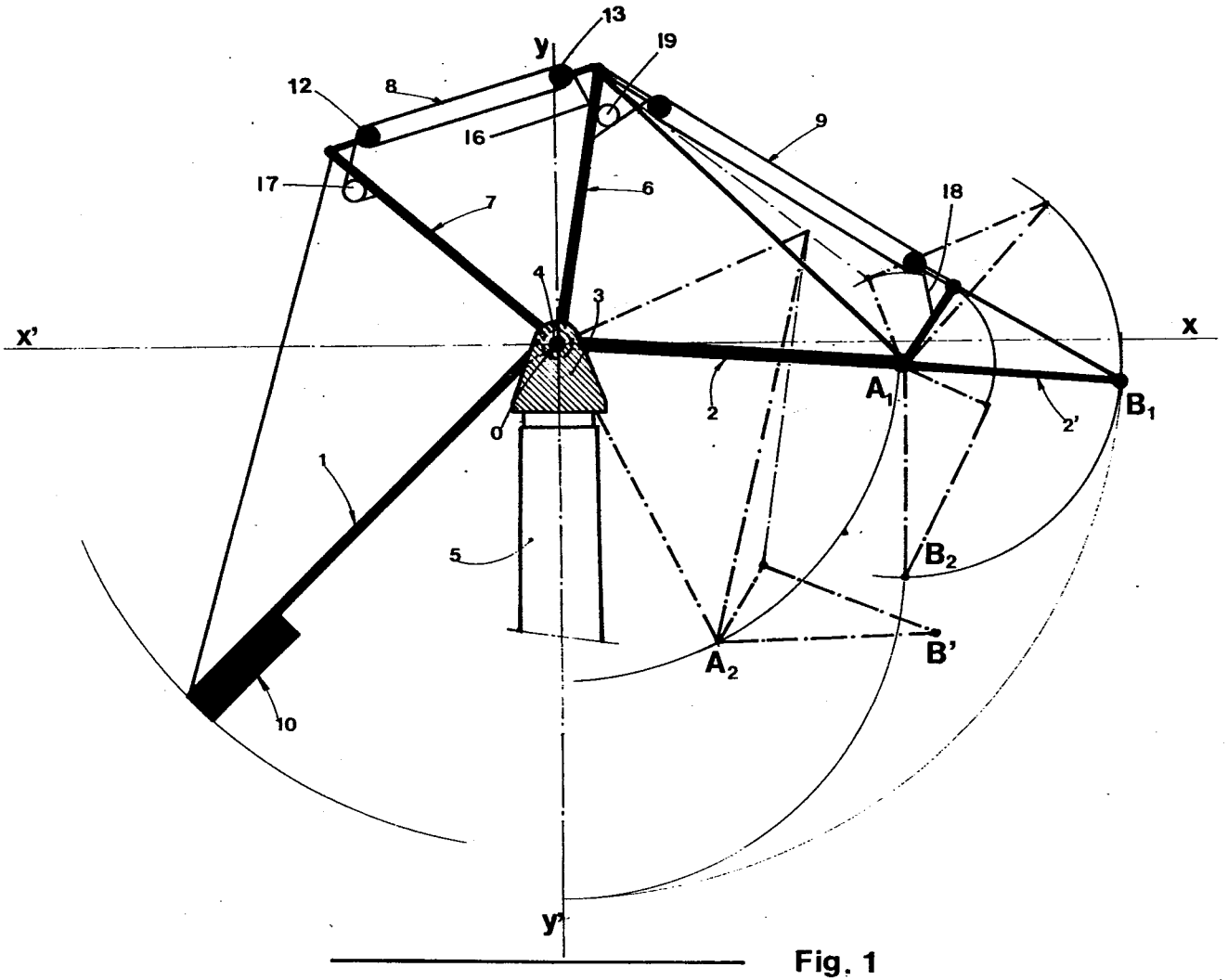
FIG. 1 is a schematic elevational view of a hoisting assembly according to the present invention.

With reference to FIG. 1, the hoisting assembly according to the present invention generally comprises a counterweight arm 1 and a jib boom having an inner member 2 and an outer member 2'. The counterweight arm and the boom extend in opposite directions, in a same vertical plane and are pivotally mounted upon a support means 3 around an horizontal common pivoting axis 4. It will however be noted that the boom and the counterweight arm may be pivotally mounted upon two separate horizontal axes disposed in parallel relationship. The support means 3 bears upon a supporting structure 5 by a bearing means allowing the whole assembly, i.e. counterweight arm 1—boom 2,2'—support means 3, to rotate over 360° around the axis Y'Y with respect to the supporting structure 5. Such a bearing means may be constituted of a pivoting means or a ball-bearing means 11, as illustrated on FIG. 2. An adjustable connecting means 8 connects the drag-boom 6 of the boom to the drag-arm 7 of the counterweight arm. It is possible, by actuating said adjustable connecting means, to change the relative angular position of the boom and the counterweight arm. Said connecting means may consist, as illustrated on FIGS. 1 and 2, in a cable passing through a pulley set 12 and 13, and having one end connected to the drag-boom 6, for example at 16 or to the drag-arm 7 while the opposite end can be actuated by a control means, for example wound around a drum mounted upon the jib boom or upon the counterweight arm in particular a power-actuated drum 17, the rotation of said drum in the direction of winding or unwinding of the cable being controlled by any appropriate means. The connecting means can also comprise a fluid actuated cylinder means.

Figure 2:
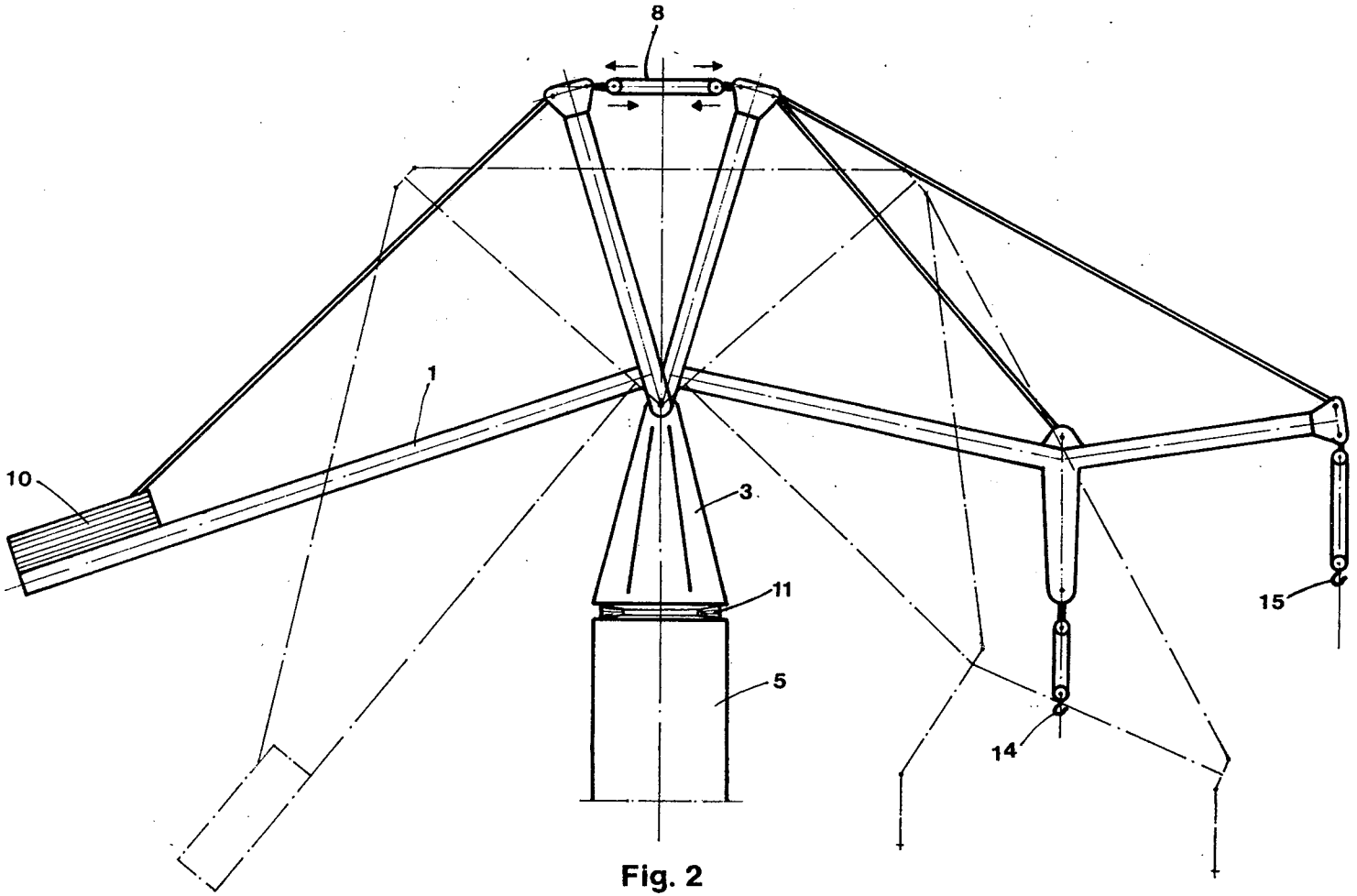
FIG. 2 is a schematic side elevational view of another embodiment of a hoisting assembly according to the present invention.

In another embodiment of the present invention (not shown) the jib boom and the counterweight arm are interconnected by two connecting arms to form a pantagraph-like structure having one apex at the point 0. A connecting means such as a fluid actuated cylinder, is connected to two separate points, each of them being on a different side of the pantograph structure, for varying the respective angular position between the boom and the counterweight arm. In a similar way, a direct connection between the counterweight arm and the boom by means of the cylinder would produce a similar configuration. The connecting means between the boom and the counterweight part can also be provided beneath them, whereby permitting to leave free the upper part of the hoisting assembly, said configuration being advantageous when said assembly is constructed in a suspended mode wherein the assembly is pivotally suspended on the supporting structure instead of being mounted upon a structure 5 as illustrated in FIGS. 1 and 2.

According to the embodiment shown on FIG. 1, the jib boom comprises two members, an inner member 2 and an outer member 2' pivotally connected at point $A_1$, at the outer end of the inner member 2. The outer member 2' is then pivotable in a vertical plane by means, for example, of a pulley and cable means 9, said cable 9 being activated in the same way as cable 8, that is for example by means of one end secured on the outer member 2' at 18 while the other end is connected to a power activated drum 19 secured on the inner member 2. The load to be lifted is suspended on a point $A_1$ or $B_1$ at the outer end of the outer member 2' by any appropriate suspending means such as a pulley and cable means or a pulley-block means. There are shown in dotted lines on FIG. 1 the limit position the inner member 2 and the outer member 2' of the boom can reach, respectively. One can see that, by pivoting in a vertical plane members 2 and 2' of the boom, the hooking points for the load $A_1$ and $B_1$ can be moved across the entire space located above and beneath the boom by reason of the displacement of the whole boom and also the displacement of the outer member with respect to the inner member by means of the tackle-block 9.

In the rest position, the counterweight arm 1 and the counterweight proper 10 extends downwards alongside the supporting structure 5 upon activation of a connecting means 8 by any appropriate remote control means (not shown). When a load is to be lifted, corresponding to the location where it has to be lead down (zone A or zone B) the operator suspends said load on the desired hook $A_1$ or $B_1$ and actuates the lifting means connecting the hooks to the parts of the boom, and/or lets manoeuvre the outer member 2' of the boom. The weight of the load exerted to the boom tends to transmit, by the connecting means 3, a torque in the clockwise direction, with respect to the point 0 (center of the axis 4), which is automatically counterbalanced by a combined movement of the boom and the counterweight around the point 0. Merely reducing the length of the connection between the counterweight arm and the boom will then permit to lift up the boom (or reversely by lengthening said connection if said connection is beneath the axis 0); by such a modification of the length of the connection, the counterweight is then lifted up and becomes more apart from the axis of the assembly and then creates a torque in a counter clockwise direction till the moment when the torque created by the load becomes sufficient to counterbalance the whole assembly. The load can then be lifted up or down vertically in the so reached balance position.

Any movement of the member 2 and/or of the member 2' of the boom, by pivoting same in the vertical plane, to obtain a shifting of the load along axis X'X in zone A or in zone B, will then immediately provoke an unbalancing of the whole assembly which in a first step will pivot in the clockwise direction around the point 0 if the load is moved away from the axis Y'Y, or in the counter clockwise direction if the load is brought back towards the axis Y'Y. To avoid any improper lifting down (or lifting up) of the boom due to the tendency of the device for self-balancing, it is sufficient to lift up or lift down the counterweight 10 by actuating the connecting means 8 in order to reach again the equilibrium of the whole assembly for the required position of the load in the zone A or zone B. It will be noted that the assembly is in stable equilibrium as long as the point $B_1$ does not pass over the axis X'X. When said point is above said axis, the whole assembly is in natural equilibrium since any displacement of the boom above the axis X'X tends to provoke an homothetic displacement of the counterweight with respect to the point 0, the whole assembly remaining in equilibrium. Moreover, in the case where the load suspended on the boom swings towards and apart the axis Y'Y, successively, the counterweight automatically reacts to oppose the dynamic forces created by said movement and tends to counterbalance them.

With such an arrangment, the objects of the present invention are met, which consists in avoiding the transmission of tipping torque to the supporting structure, whereby preventing the risk of tipping over.

There is shown, on FIG. 2, an other embodiment wherein the boom is not divided in two members 2 and 2'. In this case, hooks 14 and 15 are used in total independence from each other. The working and the use of said embodiment are similar as in the previous embodiment, except that the whole boom assembly has to be lifted up or down to effect a shifting of the load instead of only acting on the member 2' of the boom as in the above. Although two hooks have been illustrated on FIG. 2, one can understand that the number of hooks may be greater.

According to another embodiment (not shown) the jib boom may carry a dolly or trolley movable along the boom, and having a single hook suspended thereto.

It is also possible to provide separate control means for each movable element for manoeuvring the crane, or several mechanisms to simultaneously combine several movements. While the present disclosure has been made in relation with preferate constructions and arrangements of parts employed, it is to be understood that modifications and changes may be resorted to, within the scope of the appended claims without departing from the spirit of the invention.

What is claimed is:

1. A hoisting assembly for hoisting loads, comprising:
(a) a jib boom for suspending loads;
(b) a counterweight arm extending in an opposite direction from said jib boom in the same vertical plane as said jib boom;
(c) common horizontal shaft means idly pivotally supporting said jib boom and said counterweight arm for free pivotal movement of each of them about said shaft in said vertical plane and frame means supporting said common horizontal shaft means;
(d) means for lifting up and setting down loads from said jib boom and for suspending such loads from said jib boom while such loads are in a lifted up condition;
(e) linking means directly interconnecting said jib boom and said counterweight arms, said directly interconnecting means being adjustable for varying the relative angular position of the jib boom and counterweight arm to be changed in said vertical plane, said linking means further being independent of any connection to said frame means,
so that whatever the load incumbent on said jib boom due to said lifting up, setting down and suspending of loads, upon controlled adjustment of said directly interconnecting means, said jib boom, said counterweight arm, said directly interconnecting means, and said means (d) constituting a pendular assembly automatically swing freely about said common horizontal shaft to assume a steady, balanced position.

2. The hoisting assembly of claim 1, further comprising:
a pivoting means having a vertical pivot axis;
said common horizontal shaft being mounted on said pivoting means for rotation about said vertical pivot axis.

3. The hoisting assembly of claim 1, wherein said jib boom comprises:
(i) an inner member idly pivotally connected at an inner end thereof to said means (c);
(ii) an outer member pivotally connected at an inner end thereof to an outer end of said inner member;
(iii) means providing an intermediate connecting point on the outer member; and
(iv) an adjustable-length connecting means connecting said intermediate connecting point to said jib boom in such a sense that when the length of this means is adjusted, said inner member pivots with respect to said outer member in said vertical plane.

4. The hoisting assembly of claim 3, wherein said means (d) comprises:
(i) one load hooking means suspended from the outer end of said jib boom outer member; and
(ii) another load hooking means suspended from where said jib boom outer member is pivotally connected to said jib boom inner member.

5. A hoisting assembly for hoisting loads, comprising:
(a) a jib boom for suspending loads;
(b) a counterweight arm extending in an opposite direction from said jib boom in the same vertical plane as said jib boom;
(c) common horizontal shaft means idly pivotally supporting said jib boom and said counterweight arm for free pivotal movement of each of them about said shaft in said vertical plane and frame means supporting said common horizontal shaft means;
said jib boom comprising:
(i) an inner member idly pivotally connected at an inner end thereof to said means (c);
(ii) an outer member pivotally connected at an inner end thereof to an outer end of said inner member;
(iii) means providing an intermediate connecting point on the outer member; and
(iv) an adjustable-length connecting means connecting said intermediate connecting point to said jib boom in such a sense that when the length of this means is adjusted, said inner member pivots with respect to said outer member in said vertical plane;
(d) means for lifting up and setting down loads from said jib boom and for suspending such loads from said jib boom while such loads are in a lifted up condition;
said means (d) comprising:
(i) one load hooking means suspended from the outer end of said jib boom outer member; and
(ii) another load hooking means suspended from where said jib boom outer member is pivotally connected to said jib boom inner member;
(e) linking means directly interconnecting said jib boom and said counterweight arm, said directly interconnecting means being adjustable for varying the relative angular position of the jib boom and counterweight arm to be changed in said vertical plane, said linking means further being independent of any connection to said frame means,
said means (e) comprising:
(i) a cable interconnecting said jib boom and said counterweight arm; and
(ii) control means for varying the length of said cable,
so that whatever the load incumbent on said jib boom due to said lifting up, setting down and suspending of loads, upon controlled adjustment of said directly interconnecting means, said jib boom, said counterweight arm, said directly interconnecting means, and said means (d) constituting a pendular assembly automatically swing freely about said common horizontal shaft to assume a steady, balanced position; and
(f) a pivoting means having a vertical pivot axis;
said common horizontal shaft being mounted on said pivoting means for rotation about said vertical pivot axis.

* * * * *